US005806095A

United States Patent [19]

Cotten

[11] Patent Number: 5,806,095

[45] Date of Patent: Sep. 15, 1998

[54] SAFETY TROUSERS

[75] Inventor: Guy Cotten, B.P. 538, 29185 Concarneau Cedex, France

[73] Assignee: Guy Cotten, Concarneau, France

[21] Appl. No.: 652,674

[22] Filed: May 28, 1996

[30] Foreign Application Priority Data

Jul. 10, 1995 [FR] France ..... 95 08308

[51] Int. Cl.[6] ..... A41D 1/08

[52] U.S. Cl. ..... 2/79; 2/69; 2/227; 2/94

[58] Field of Search ..... 2/69, 69.5, 79, 2/227, 94, 84, 310, 311, 312, 315, 338, 108, 237, 230, 229, 231, 235, 76

[56] References Cited

U.S. PATENT DOCUMENTS

| | | | |
|---|---|---|---|
| 2,668,957 | 2/1954 | Schmidt | 2/227 |
| 3,074,074 | 1/1963 | Lovering | 2/94 |
| 3,484,870 | 12/1969 | Tempelhof | 2/227 |
| 3,973,643 | 8/1976 | Hutchinson | 2/94 |
| 4,273,216 | 6/1981 | Weissmann | 2/94 |
| 4,549,315 | 10/1985 | English et al. | 2/227 |
| 4,731,882 | 3/1988 | Ekman | 2/94 |
| 4,843,647 | 7/1989 | Phillips, Sr. et al. | 2/79 |
| 5,136,724 | 8/1992 | Grilliot et al. | 2/227 |
| 5,214,806 | 6/1993 | Flores | 2/312 |

*Primary Examiner*—Jeanette E. Chapman
*Attorney, Agent, or Firm*—Lambert & Garrison; Scott B. Garrison

[57] ABSTRACT

Safety Trousers comprising two legs linked by a crotch. The trousers are chest high and include an upper chest part and a back part linked by adjustable shoulder straps. The safety trousers also include a strap, permanently affixed to the sides and back of the trousers but free from the sides to the front. The free ends of the straps are designed to be retained by a flap which serves to nonpermanently affix the strap in a configuration reminiscent of a belt. A tether is designed to be attached to the free ends of the strap. In the event of a dynamic force that would lift a wearer off his feet, the flaps would release and the dynamic force would act upon the individual's underarm region. This results in the individual remaining in an upright and relatively safe condition. The invention is especially suitable for the sailing and boating industry.

15 Claims, 2 Drawing Sheets

SAFETY TROUSERS

CROSS REFERENCE TO RELATED APPLICATION

This application claims a right of priority from French Patent Application Serial Number 95 08308 filed Jul. 10, 1995.

BACKGROUND OF THE INVENTION

The present invention relates to the field of safety apparel. More particularly, it relates to a new pair of safety trousers especially suited for the yachting industry. On board a yacht or other boat, it is important that each individual, either amateur or professional be capable of protecting himself against the risks of falls onboard or overboard.

The solutions now offered generally consist of a safety harness that an individual wears over his jacket. A tether is attached to the safety harness on one side and to a fixed part of the boat on the other side. Thus, if for any reason the individual falls on the deck he can get up quickly and in extreme cases, the safety harness prevents him from falling overboard. Another solution which has already been proposed consists of a safety harness integrated into the jacket itself.

The problem with this solution is that, generally it has been the case that the individual when on deck wears only the bib trousers which are normally made of a waterproof fabric. When necessary he must take the time to put on either the safety harness or the jacket with its integrated safety harness. This time can be critical when urgent maneuvers must be performed. On the other hand if the individual does not wear a stand-alone safety harness or a jacket with an integrated safety harness the risks to himself, as well as to the boat and the remainder of the crew, are increased significantly during the maneuvers. At a minimum, the maneuvers cannot be made with the same efficiency because the individual is obligated to support himself with one hand, thus leaving only one hand to operate.

SUMMARY OF THE INVENTION

It is therefore the aim of the present invention to reduce the above enumerated drawbacks by providing a pair of chest high trousers capable of offering acceptable safety conditions with a minimum of constraints placed upon the individual.

The present invention is a safety trouser comprising a pair of legs linked together by a lower portion, a crotch; and an upper portion which partially covers the chest and back of an individual, further equipped with adjustable shoulder straps.

The practicality and patentable distinction of these safety trousers is an open strap around the upper chest and back portion of the trousers. This strap is integrally sewn into the trouser around the back and sides of the upper of the trousers. However, said strap is left free and loose at the front ends located at the front of the upper chest part of the trousers. Both ends of the strap meet approximately in the front middle of the upper part of the trousers and each end has a loop enabling it to be attached to a tether. Another embodiment would be to provide the strap integrally sewn into the trouser beyond the sides continuing toward the front of the trousers, so that only the very end of the strap is free.

In order to better contain the loose strap ends, a turn down flap affixed to the trouser at each front portion where the straps are loose and free could be provided. However, turn down flaps are unnecessary if the strap were free only at the ends themselves. Such a flap if desired would be turned down and removably fastened to the trouser itself to at least partially contain the free ends of the strap. An inside face of the turn down flaps and the mating front portion of the trousers would be provided with an attachment means such as self gripping tape or a hook and loop fastener to secure the free ends of the strap in place at the same height as the remainder of the strap. The width of the turn down flaps and of the self gripping tape should be wider than the width of the strap in order to allow each flap to loosely envelop the strap and secure to the trouser itself by the attachment means. Other attachment means such as snaps could be used instead of self gripping tape or hook and loop fasteners.

One advantage to the use of hook and loop type fasteners on the turn down flaps would be that the flaps would have the desirable tendency to release were sufficient force to be applied to the tether which tended to lift the individual off of his feet. Releasing the turn down flaps would have the effect of shifting the tether's attachment point toward a more stable center of gravity on the individual actually located at the individual's upper lateral chest region. This attachment point would help maintain the individual's head and shoulders in a relatively upright position. This effect is reinforced by ensuring that the strap is integrated into the trousers at chest level and not at waist level.

An additional advantage to the trousers is that the safety belt integrated into the trousers ensures that any pulling force applied to the tether serves to further seat the trousers on the individual rather than a jacket and harness combination in which the jacket could be pulled off the individual by the tether. Suspenders attached to the top of the trousers help hold the trousers and strap in the correct position to ensure that any force applied to the tether acts upon the person at the individual's upper lateral chest region.

It is therefore an object of this invention to provide a solution which overcomes the need for an individual to wear a separate safety harness over his clothes or a jacket with an integrated safety harness, thereby eliminating the need for an individual who has removed his separate safety harness or his integrated jacket and safety harness combination to be placed in an emergency situation without having the time required to don such equipment.

It is another object of the present invention to provide safety trousers which provide ample protection for an individual yet do not unnecessarily constrain movement.

Yet another object of the present invention is to eliminate the necessity for an individual to have a separate safety harness or an integrated jacket and safety harness combination altogether.

It is another object of the present invention to provide safety trousers which extend upward to cover a lower portion of the chest and back of an individual further having a safety strap affixed to the trousers at the sides and the back of the trousers in which looped free ends of the strap are located at the front of the trousers and these looped free ends can be attached firmly yet removably to a fixed object on a boat by attaching a tether to the fixed object and securing the opposite end of the tether to the looped free ends of the straps.

Another object of the present invention is to provide safety trousers which have a safety strap affixed to the trousers along the back and sides of the trousers approximately at chest height leaving the front ends of the safety strap free wherein these free ends are further loosely retained by flaps capable of quickly releasing the free ends of the straps in the event sufficient upward force is applied to a tether attached to the free ends of the straps.

Still another object of the present invention is to provide a pair of safety trousers wherein any force tending to lift an individual off his feet is applied to regions on the persons body which tend to maintain a generally upright body position.

An additional object of this invention is to provide safety trousers adaptable for use in a wide range of professions and situations, and not limited solely to the boating industry.

BRIEF DESCRIPTION OF THE DRAWINGS

The novel features considered characteristic of the invention are set forth in the appended claims. The invention itself, however, both as to its construction and its method of operation, together with additional objects and advantages thereof, will best be understood from the following description of the specific embodiments when read and understood in connection with the accompanying drawing.

Additional advantages and characteristics of the invention will appear with a more detailed description of a preferred embodiment of the invention; this description and the corresponding drawings are meant to serve only as a nonlimiting example of the applicant's preferred embodiment.

DETAILED DESCRIPTION OF THE PREFERRED EMBODIMENT

Figure 1:
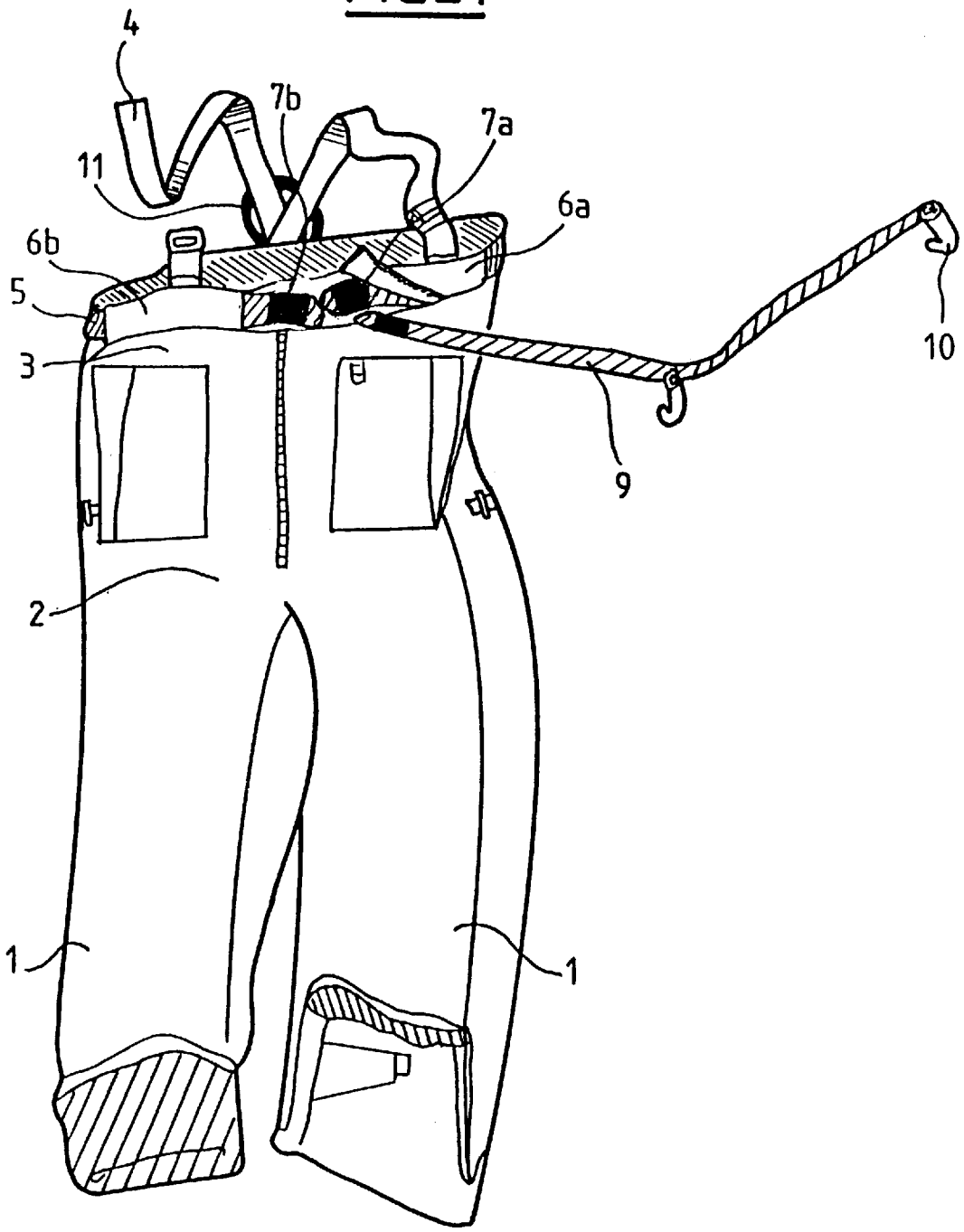
FIG. 1 is a front elevation view of a safety trousers in accordance with the present invention.

With reference to FIG. 1, chest high safety trousers are depicted having two legs (1) linked together at a lower portion, a crotch (2), and further having a waist portion and an upper chest portion (3) equipped with shoulder straps (4). Upper chest portion (3) has a safety strap (5) integrated into said safety trousers at said upper chest portion (3). Safety strap (5) circumferentially encompasses upper chest portion (3) and is permanently incorporated and affixed into said safety trousers at back and a first and second attachment location along side sections of upper chest portion (3).

Figure 2:
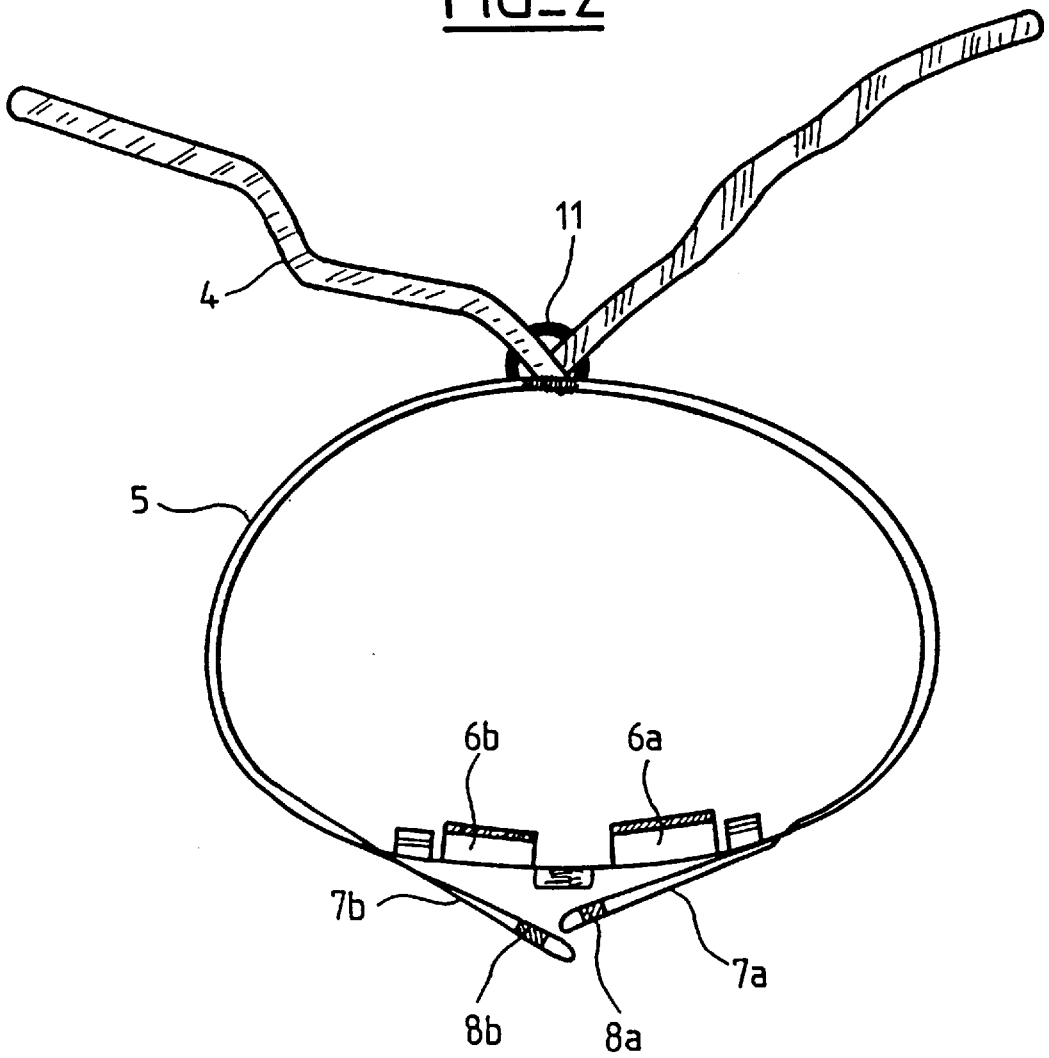
FIG. 2 is a plan view looking in the direction from the top downward of the FIG. 1 safety trousers.

Safety strap (5) at a point where it continues from said side sections to a front section of upper chest portion (3), is loose. Front section of upper chest portion (3) is defined as that section extending from a first side section to a second side section, corresponding essentially to an individual's lateral trunk region, around said trousers across that portion normally worn on said individual's frontside. FIG. 2 depicts safety strap (5) further depicting said loose ends (7*a* and 7*b*), both having loops (8*a* and 8*b*) at endmost portions of said loose ends. Loops (8*a* and 8*b*) are readily formed by folding the loose ends of the strap together and stitching. A stronger loop could be made by first twisting loose ends (7*a* and 7*b*) and then stitching said loose ends in the twisted embodiment. This procedure would result in a safety strap (5) that is stronger in the looped area without significantly impacting the remainder of the safety strap itself.

Front section of upper chest portion (3) also has turndown flaps (6*a* and 6*b*) with a reattachable securing means, such as hook and loop type fasteners, like VELCRO® on an inside face of said flaps. Said flaps are capable of mating with a complementary securing means placed on an external face of upper chest portion (3), or mating point below said strap. Said flaps when secured by securing means, loosely encompass said loose ends (7*a* and 7*b*) of safety strap (5) allowing loops (8*a* and 8*b*) to protrude from said turndown flaps. Width of safety strap (5) being narrower than the width of the turn down flaps, permits said flaps to secure to trousers and loosely retain loose ends (7*a* and 7*b*) of safety strap (5) to upper chest portion (3) of the trousers. FIG. 1 depicts turn down flap (6*b*) in a fully secured position, thereby retaining loose end (7*b*) of safety strap (5), whereas turn down flap (6*a*) is shown in a half open position only partially retaining loose end (7*a*).

Loops (8*a* and 8*b*) formed at endmost portions of said loose ends (7*a* and 7*b*) of safety strap (5) are capable of insertion into a tethering means, such as a rope or cable attached to some object capable of securing an individual wearing said safety trousers. Typical objects could be a mast on a boat, a crane, or any other object capable of supporting an individual's weight against a dynamic load exerted upon the individual. One embodiment of such a tethering means is depicted on FIG. 1. On this embodiment, tether (9) has a multiplicity of attachment means affixed thereon, such as snap-on hooks (10), as well as a loop positioned at an end of the tether attached to the trousers. Both tether (9) and strap (5) ideally would be made of material having a strong resistance to failure in tension. Many textiles known in the art satisfy this requirement, one that comes to mind being nylon webbing. An advantage to the use of textiles is that the entire invention could be made of a nonmetallic material if this property were advantageous. One such advantage being that it would eliminate the possibility of injury to the user caused by a metal element impacting the user's face or other body parts. Additionally, a nonmetallic material could be made electrically nonconductive as well to minimize electrical accidents for wearers in some industries.

Snap-on hooks (10) provide the actual attachment means which attaches the individual to the boat or other object. The material of which such snap-on hooks could be made could be plastic, metal, or any other material capable of supporting an individual. Such materials are abundant in the prior art. FIG. 1 depicts two such snap-on hooks. This configuration enables the individual to attach a first distant-most hook to a first object thereby providing a great deal of freedom in movement. A second distant-most hook can be attached to some other object, thereby reducing the degree of movement available to the individual. Any number of hooks could be provided and would work in a similar fashion, the closer the hook to the individual, the less movement allowed. The number of hooks is really only limited to that number practical for the application that such trousers would be used for.

To attach the tether (9) to safety strap (5), the end of tether (9) containing the loop is inserted through both loops (8*a* and 8*b*). The other end of tether (9) having no loop is threaded through the tether loop and cinched thereby keeping all the various components firmly tightened. Safety strap (5) is of such a length so that both loops (8*a* and 8*b*) will superimpose when the tether (9) is attached through the safety strap. The back of the upper chest part (3) of the trousers could also be equipped with a loop ( 11) in order to attach tether (9) to the back of the trousers or to provide a means to hang the trousers when not in use. Another form of the invention would be to attach a safety hook to the tether at its looped end which would enable the individual to attach the tether directly to strap (5). A metallic ring or other attachment means could be attached directly to each strap end (7*a* and 7*b*) instead of providing loops (8*a* and 8*b*) in order to attach the tether.

The trousers described above enable an individual to attach himself to an object at any time and keep his hands free. Additionally, the trousers have been designed to provide a high degree of safety to the individual without the use of additional and sometimes bulky equipment. Although the invention has been described herein for a specific use in yachting, these trousers are readily adaptable to use in other locations where the individual must be protected by being securely fastened to some object. While the invention has been described and illustrated with reference to a specific embodiment thereof, it is understood that other embodiments may be resorted to without departing from the invention. Therefore the form of the invention set out above should be considered illustrative and not as limiting the scope of the following claims.

What is claimed is:

1. Trousers comprising:

two legs linked by a crotch portion;

an upper chest portion;

an upper back portion having shoulder straps attached therebetween;

a strap means permanently affixed at a first and second attachment location along side portions respectively and continuing around to said upper back portions said strap means further comprising at least two free ends located at said upper chest portion, said at least two free ends capable of meeting at said upper chest portion; and a detachable tether means having at least one of a multiplicity of attachment means affixed thereon, each of said multiplicity of attachment means capable of securedly fastening said individual to an object and attachably mounted to said strap means capable of sustaining an individual's body weight against a dynamic load exerted upon said individual;

wherein said at least two free ends of said strap means are retained by at least one flap extending from a first end from said upper chest portion overlapping said free ends of said strap means and attachably mounting at a second end to said trousers at a mating point below said strap means and further terminating in a loop capable of attachably receiving said tether at a first end.

2. Trousers according to claim 1, wherein said mating point of said trousers and said second end of said flap in combination comprise a reattachable securing means.

3. Trousers according to claim 2, wherein said flaps release said free ends of said strap means upon subjecting said individual via said tether means to a quantity of dynamic load capable of lifting said individual in the air; wherein the release of said flaps results in said strap exerting said dynamic load upon the individual at said first and second attachment locations upon said trousers thereby maintaining said individual's balance in a nongrounded position.

4. Trousers according to claim 3, wherein said reattachable securing means comprises a hook and loop type fastener.

5. Trousers according to claim 4, wherein materials of said trouser device are electrically nonconductive.

6. Trousers according to claim 5, suitable for use in a boating environment.

7. Trousers comprising two legs linked by a crotch portion, an upper chest portion and an upper back portion having shoulder straps attached therebetween, a strap means permanently affixed at a first and second attachment location along side portions respectively and continuing around to said upper back portion, and a detachable tether means attachably mounted to said strap means capable of sustaining an individual's body weight against a dynamic load exerted upon said tether means by an individual losing his balance and subjecting said individual's weight to said tether means; said strap means further comprising at least two free ends located at said upper chest portion, being further retained by at least one flap attachably mounted to said trousers to overlap and retain said free ends of said strap means.

8. Trousers according to claim 7, wherein each of said at least two free ends terminate in a loop capable of attachably receiving said tether at a first end.

9. Trousers according to claim 8, wherein said tether further comprises a multiplicity of attachment means affixed thereon, each of said multiplicity of attachment means capable of securedly fastening said individual to an object.

10. Trousers according to claim 7, wherein said at least one flap further extends from a first end from said upper chest portion and attachably mounts at a second end to said trousers at a mating point below said strap means.

11. Trousers according to claim 10, wherein said mating point of said trousers and said second end of said flap in combination comprise a reattachable securing means.

12. Trousers according to claim 11, wherein said flaps release said free ends of said strap means upon being subjected to a quantity of dynamic load resulting from said individual slipping, and wherein said tether means affixed to a suitable object supports said individual at said first and second attachment locations on said trousers thereby maintaining said individual's balance in a nongrounded position.

13. Trousers according to claim 12, wherein said reattachable securing means comprises a hook and loop type fastener.

14. Trousers according to claim 13, wherein materials of said trouser device are electrically nonconductive.

15. Trousers according to claim 14, suitable for use in a boating environment.

* * * * *